US008813646B2

(12) United States Patent
Yamamoto

(10) Patent No.: US 8,813,646 B2
(45) Date of Patent: Aug. 26, 2014

(54) LABEL PRINTER WITH PEELING UNIT HAVING ADJUSTABLE GUIDE SURFACES

(75) Inventor: Hajime Yamamoto, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 144 days.

(21) Appl. No.: 13/471,618

(22) Filed: May 15, 2012

(65) Prior Publication Data

US 2012/0318191 A1 Dec. 20, 2012

(30) Foreign Application Priority Data

Jun. 16, 2011 (JP) ..... 2011-134039

(51) Int. Cl.
*B41J 15/04* (2006.01)
*B65C 9/18* (2006.01)
*B65H 41/00* (2006.01)

(52) U.S. Cl.
USPC .... 101/288; 400/611; 156/719; 156/DIG. 37; 221/73

(58) Field of Classification Search
CPC ..... B65C 2009/0012; B65C 2210/0078; B65C 9/1865; B65C 9/1869; B65C 9/26; B65C 9/262; B65C 9/46; B65H 41/00
USPC ..... 101/288; 156/719, DIG. 37; 221/73; 400/611
See application file for complete search history.

(56) References Cited

U.S. PATENT DOCUMENTS

| | | | | |
|---|---|---|---|---|
| 4,189,337 | A * | 2/1980 | Higgins et al. | 156/351 |
| 7,975,876 | B2 * | 7/2011 | Farmer et al. | 221/73 |
| 2011/0126725 | A1 * | 6/2011 | Kolp et al. | 101/47 |

FOREIGN PATENT DOCUMENTS

| | | | | |
|---|---|---|---|---|
| JP | 2001-261226 | | 9/2001 | |
| JP | 2005-112366 | | 4/2005 | |
| JP | 2007076721 | A * | 3/2007 | B65C 9/18 |

OTHER PUBLICATIONS

Office Action of Notification of Reasons for Refusal for Japanese Patent Application No. 2011-134039 Dated Apr. 16, 2013, 4 pgs.

* cited by examiner

*Primary Examiner* — Daniel J Colilla
(74) *Attorney, Agent, or Firm* — Amin, Turocy & Watson, LLP

(57) ABSTRACT

Provided is a label printer that includes a conveyance unit that conveys a label paper on which a label is attached and a printing unit that prints on the label. The label printer also includes a peeling unit that includes one pair of members separated in a direction orthogonal to the conveyance direction of the label paper and peels the label from a backing paper. The label printer also includes a backing paper conveyance unit that conveys the backing paper and a moving unit that moves the peeling members towards a direction orthogonal to the conveyance direction of the backing paper.

8 Claims, 2 Drawing Sheets

LABEL PRINTER WITH PEELING UNIT HAVING ADJUSTABLE GUIDE SURFACES

CROSS-REFERENCE TO RELATED APPLICATION

This application is based upon and claims the benefit of priority from Japanese Patent Application No. 2011-134039, filed Jun. 16, 2011, the entire contents of which are incorporated herein by reference.

FIELD

Embodiments described herein relate to a label printer which discharges paper after peeling labels from backing paper.

BACKGROUND

A known label printer prints information on a plurality of labels which are continuously attached on peel backing paper by a printing head and discharges the paper after peeling the labels on which the information is printed from the backing paper. In this label printer, the peeling is carried out by a peeling mechanism for peeling the labels, and the labels are attached on articles such as boxes and the like which are conveyed to the homes of customers. The peeling mechanism used in this label printer bends the backing paper at an acute angle by peeling members, so as to peel the labels from the backing papers. In order to bend the labels at the acute angle on the backing paper, a winding shaft for winding the backing paper and the like are used for giving tensile force to the backing paper.

Moreover, in order to peel the labels from the backing paper easily, the shape of the peeling members of the peeling mechanism is determined. As an example, observed from a downstream side in the conveyance direction of the labels, label peeling members are formed into an arch shape which is protruded towards the sides of the backing paper from a central unit, thereby peeling the labels from the backing paper easily.

DETAILED DESCRIPTION

According to one embodiment, a label printer comprises, a conveyance unit configured to convey a label paper on which label is attached; a printing unit configured to print on the label attached on the label paper conveyed by the conveyance unit; a peeling unit configured to include one pair of members separated in a direction orthogonal to the conveyance direction of the label paper, and to peel the label from a backing paper through a structure that the distance between a plane forming the convey path and a surfaces of the members, which are opposite to a convey path, increase gradually along the direction from the center to the side ends of the label paper; a backing paper conveyance unit configured to convey the backing paper that the labels are peeled by the peeling members; and a moving unit configured to move at least one of the peeling members towards a direction orthogonal to the conveyance direction of the backing paper.

Figure 1:
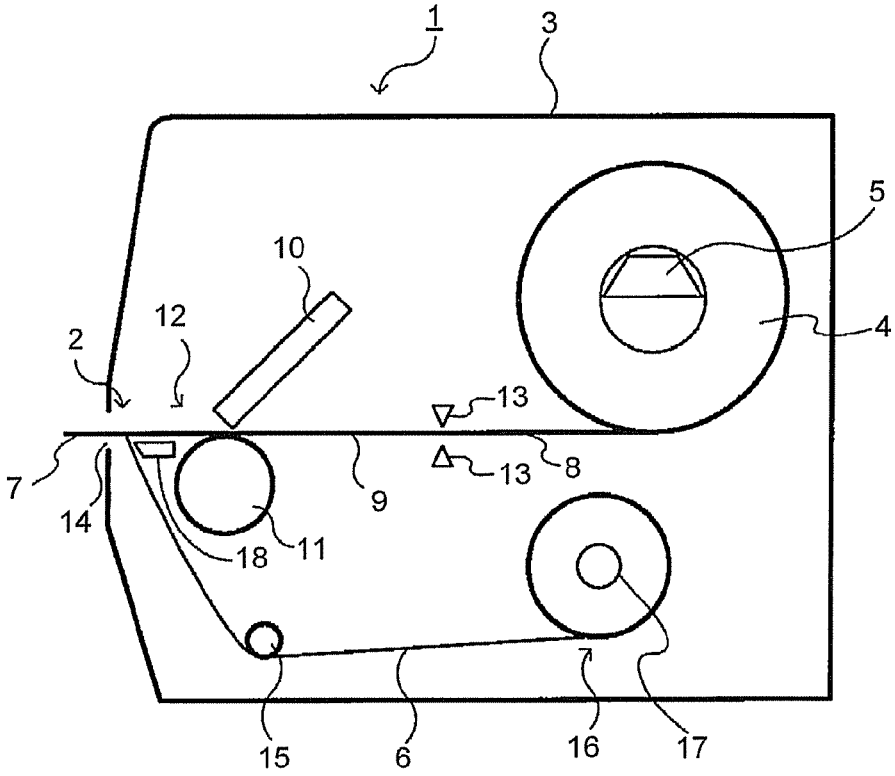
FIG. 1 is a cross-sectional view of the label printer in the first embodiment.
Figure 2:
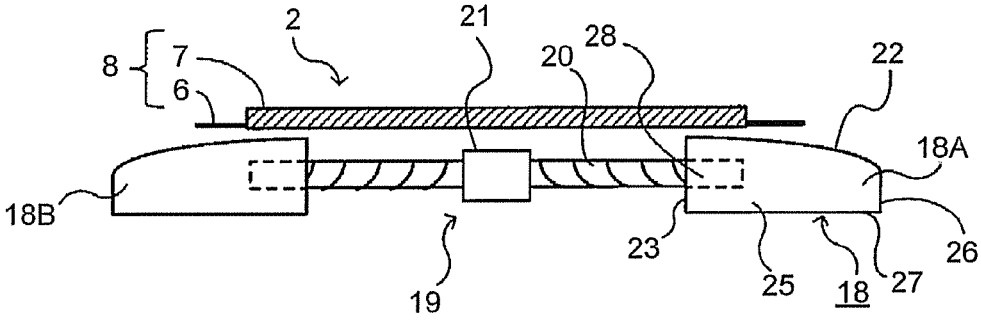
FIG. 2 is a view showing a main unit of a label peeling mechanism of the label printer.
Figure 3:
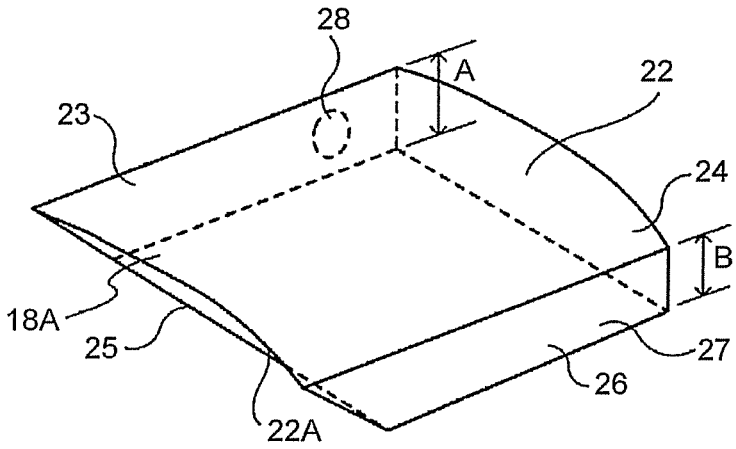
FIG. 3 is an enlarged view of the label peeling members.

Hereinafter, FIG. 1 to FIG. 3 are used for illustrating the embodiment. FIG. 1 is a cross-sectional view of the label printer 1. FIG. 2 shows a main unit of a peeling unit 2 of the label printer 1. FIG. 3 is an enlarged view of the label peeling members.

The printer 1 comprises a holding unit 5 which holds a label roll 4 in a case 3. The label roll 4 is formed by attaching a plurality of labels 7 at fixed intervals on peel backing paper 6. The plurality of labels 7 and backing paper 6 comprise label paper 8. Label paper 8 drawn from the label roll 4 is conveyed on the conveyance path 9 and is further clamped by a thermal head 10 and a platen roller 11 to be printed. The printer 1 generates data to be printed by a control unit (not shown in figures) based on data provided by an external computer which is not shown in the figures, and prints the data on the labels 7 by utilizing the thermal head 10. The platen roller 11 is rotated by a motor which is not shown in the figures, so as to convey the label paper 8. Herein, in order to simplify the following description, the thermal head 10 and the platen roller 11 are collectively named as the printing unit 12.

On the conveyance path 9 between the holding unit 5 and the printing unit 12, a sensor 13 used for detecting a printing position is arranged. The sensor 13 comprises transmission sensors provided with a light-emitting component and a light-receiving component which clamp the conveyance path 9 and are configured oppositely. The sensor 13 detects the positions of the labels 7 according to the difference of the light transmission amounts of the unit of the label paper 8 on the backing paper 6 and the overlapped unit of the backing paper 6 and the labels 7. The printer 1 decides the printing position according to the detected positions of the labels 7.

The peeling unit 2 is arranged at the downstream side of the paper conveyance direction of the printing unit 12. The detailed contents about the peeling unit 2 are described in the following text, the backing paper 6 is bent at an acute angle, and the labels 7 are peeled from the backing paper. The labels 7 peeled from the backing paper 6 discharge paper from an issue port 14 arranged on the case 3. The conveyance of the paper is stopped when only the back ends of the labels 7 are still connected to the backing paper 6. Therefore, an operator attaches the labels on articles after peeling the labels 7 at the issue port 14 from the backing paper 6.

The backing paper 6 from which the labels 7 are peeled is wound by a winding unit 16 by a backing paper guiding component 15. The winding unit 16 enables a shaft 17 of the winding unit 16 and the conveyance of label paper 8 to be synchronous to carry out rotary driving by a motor which is not shown in the figures, thereby carrying out winding while giving proper tensile force to the backing paper 6 by the peeling unit 2.

In FIG. 2, when the label paper 8 is placed in the printer 1, originally, the backing paper 6 which is bent due to the peeling unit 2 may not be seen due to the peeling unit 2, and in FIG. 2, in order to be convenient for description, the backing paper 6 which is bent due to the peeling unit 2 is omitted in the figure.

The peeling unit 2 comprises the peeling members 18 and an adjusting mechanism 19 which adjusts the positions of the peeling members 18 in the width direction of the backing paper (the direction orthogonal to the conveyance direction). The peeling members 18 comprise a first component 18A which is arranged on one side of the width direction of the label paper 8, and a second component 18B which is arranged on the other side of the width direction of the label paper 8.

The first component 18A and the second component 18B of the peeling members 18 are parallel to the paper conveyance direction and are symmetric with respect a plane that is at right angles to the paper conveyance path 9. Therefore, in the following descriptions, the first component 18A is described, and the descriptions about the second component 18B are omitted. The first component 18A is made of an aluminum casting, however, and also may be made of a metal plate and the like. The first component 18*a* comprises a conveying surface 22, an inner side surface 23, a back surface 24, an inclined surface 25, an outer side surface 26 and a bottom surface 27, wherein the conveying surface is opposite to the paper conveyance path 9 and is further in contact with the backing paper 6; the inner side surface is positioned at the central side of the width direction of the label paper with respect to the conveying surface 22; the back surface is positioned at the upstream side of the conveyance direction of the label paper with respect to the conveying surface; the inclined surface is inclined towards a direction that is opposite to the conveyance direction of the label paper relative to a vertical direction in a way of being along backing paper 2 bent at the downstream side of the conveyance direction of the label paper with respect to the conveying surface 22; and the outer side surface and the bottom surface are positioned at the outer side of the width direction of label paper. The conveying surface 22 is inclined in the way that the further the conveying surface moves away from the virtual plane of the conveyance path facing to the outer side of the width direction of the label paper, the lower the conveying surface becomes. That is, when the height of the side of the inner side surface 23 of a first component 19A shown in FIG. 3 is set to be (A) and that of the side of the outer side surface 26 is set to be (B), the relation that (A) is more than (B) exists. Moreover, a downstream side end unit 22A of the conveying surface 22 in the conveyance direction of the label paper is orthogonal with respect to the conveyance direction of the label paper. The inner side surface 23 is provided with a hole 28 through which a drive shaft 20 penetrates. Herein, the virtual plane indicates the plane of an ideal conveyance path which is supposed to start from the label roll 4 and ends at the peeling unit 2, and any units are all linear in the width direction of the paper.

The adjusting mechanism 19 comprises the drive shaft 20 and a handle 21 (operating unit). The driving shaft 20 is arranged between the first component 18A and the second component 18B. Moreover, the drive shaft is provided with a screw thread which is screwed in a screw thread arranged in the hole 28. In addition, at the right-side and the left-side of the handle 21, the screw threads whose directions are formed in opposite direction each other. Moreover, the handle 21 is integrally provided with the drive shaft 20 in the approximate center of the drive shaft 20, and the drive shaft 20 may be rotated by rotating the handle 21. Moreover, if the handle 21 is rotated towards one direction, the first component 18A and the second component 18B approach each other, and if the handle 21 is rotated towards another direction, the first component 18A and the second component 18B are mutually separated.

In the printer 1 formed in this way, the positions of the first component 18A and the second component 18B are adjusted first by determining the width of the backing paper 6. The drive shaft 20 is rotated by rotating the handle 21, so as to move the first component 18A and the second component 18B. At this moment, the positions are adjusted by the handle in the way that backing paper 6 is positioned between the inner side surface 23 and the outer side surface 26 of the first component 18A. Moreover, the label roll 4 is held in the holding unit 5, and after the label paper 8 is drawn from the label roll 4, the label paper passes through the space between the light-receiving component and the light-emitting component of the sensor 13 and that between the thermal head 10 and the platen roller 11 of the printing unit 12 and is placed on the paper conveyance path. Moreover, the backing paper 6 of the label paper 8 is bent by utilizing the peeling unit 2 and is wound on the winding unit 16 by the backing paper guiding component 15. At this moment, the operator rotates the winding unit 16 with a hand, and the backing paper is not slack from the peeling unit to the winding unit 16. Thus, the placement of the label paper 8 is completed.

After the data are received from the external computer, the platen roller rotates and draws the label paper 8 from the label roll 4 to begin conveying the label paper. The data to be printed are printed on the labels 7 of the conveyed label paper 8 by the printing unit 12. Moreover, the backing paper 6 is pulled and dragged as being wound by a winding unit 17, so that the labels 7 are peeled by the peeling unit 2. At this moment, the right end of the first component 18A and the left end of the second component 18B in the two ends of the peeling unit 2 are lower than a central unit. Therefore, the backing paper 6 is along the shape of the conveying surface 22 of the peeling unit, and only the end of the backing paper is slightly bent, and on the other hand, the labels 7 per se straightly advance. Therefore, the end of the labels 7 in the width directions are easily peeled from the backing paper 6. Moreover, the labels 7, the end of which are begun to be peeled, extend all over and are continuously peeled from the backing paper 6. The peeled labels 7 are sent out towards the conveyance direction of the paper conveyance path 9 and discharge the paper from the issue port 14. At this moment, as the back ends of the labels 7 are attached on the backing paper 6, the operator takes down the labels 7 discharging the paper with fingers and the like and attaches the labels 7 on the articles. On the other hand, the backing paper 6 from which the labels 7 are peeled is wound by a winding shaft 17 through the backing paper guiding component 15.

As thus, in this embodiment, as the peeling unit is formed into the shape that the side end of the backing paper 6 is pulled and dragged downwards lower than the central unit. Therefore, the end of the labels 7 are easily peeled from the backing paper 6 first. Moreover, as the positions of the first component 18A and the second component 18B may be changed, the positions of the first component 18A and the second component 18B may be altered according to the sizes of the labels 7, thereby always carrying out favorable peeling.

Figure 4:
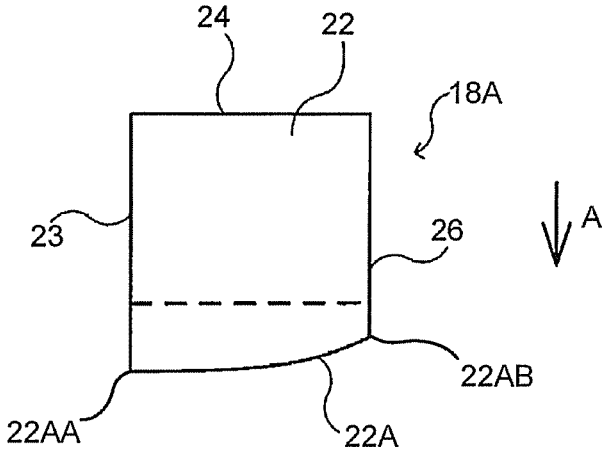
FIG. 4 is a plan showing a modified example of a label peeling unit.

In the previous embodiment, the peeling member 18A is an example that has a downstream end 22A of the conveying surface 22 that is linear, but as shown in the plan view of the peeling member 18A in FIG. 4, the shape of the peeling member may be curved. The downstream end 22AB on the side of the outer side surface 26 is located at a position more upstream than the downstream end 22AA on the side of the inner side surface 23 of the conveying surface 22. Thus the center of the backing paper located at the downstream end in the paper conveyance direction shown by an arrow A is made to swell outwards (and thus curve) so that it is located more downstream than end 22AB. With this shape, even though labels 7 with different widths are used, the sides of the labels 7 may always peel from the backing paper 6 easily.

In the embodiment, the handle 21 is arranged at a position which is protruded towards the right side of the first component 18A in FIG. 2, but further may be adjusted from the side direction of the paper conveyance path 9 after the backing paper 6 is placed. Moreover, the conveyance of the backing paper also may be carried out by a pinch roller and the platen roller 11, and the pinch roller is arranged to clamp the backing paper 6, is in contact with the platen roller 11 and rotates.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A label printer, comprising:

a conveyance unit configured to convey a label paper, wherein the label paper comprises a label attached to a backing paper;

a printing unit configured to print on the label;

a peeling unit configured to include a pair of peeling members separated in a direction orthogonal to a conveyance direction of the label paper, and to peel the label from the backing paper through a structure, wherein a distance between a plane formed by a convey path and surfaces of the members, which are opposite to a convey path, increases gradually along the direction from a center to side ends of the label paper;

a backing paper conveyance unit configured to convey the backing paper in a conveyance direction; and a moving unit configured to move at least one of the peeling members in a direction orthogonal to the conveyance direction of the backing paper, the moving unit is provided with screw threads around a drive shaft, and screws the drive shaft with the screw threads arranged in holes of the peeling unit.

2. The label printer according to claim 1, wherein the pair of peeling members are respectively positioned at the end sides of the backing paper.

3. The label printer according to claim 1, wherein the moving unit is provided with an operating unit which may be operated by an operator to move the peeling unit along a width direction of the backing paper.

4. The label printer according to claim 1, wherein the moving unit is arranged to be capable of moving the pair of peeling members.

5. A label printer, comprising:

a holding unit configured to hold a label paper that comprises a plurality of labels and backing paper, wherein the labels are attached on to the backing paper;

a conveyance unit configured to draw the label paper from the holding unit and convey the label paper to a printing unit configured to print on the label;

one pair of peeling members, each member being positioned at a different outer sides of the label paper and each member having a center edge portion located at a downstream end, in a label paper conveyance direction, in contact with the backing paper that curves outwards in the label paper conveyance direction;

a backing paper conveyance unit configured to convey the backing paper in a conveyance direction; and a moving unit configured to move at least one of the peeling members in a direction orthogonal to the conveyance direction of the backing paper, the moving unit is provided with screw threads around a drive shaft, and screws the drive shaft with the screw threads arranged in holes of the peeling members.

6. The label printer according to claim 5, wherein each of the peeling members are respectively positioned at the sides of the backing paper.

7. The label printer according to claim 5, wherein the moving unit is provided with an operating unit which may be operated by an operator to move the peeling members along a width direction of the backing paper.

8. The label printer according to claim 5, wherein the moving unit is arranged to be capable of moving both of the peeling members.

* * * * *